US012091622B2

(12) United States Patent
Sanson

(10) Patent No.: US 12,091,622 B2
(45) Date of Patent: Sep. 17, 2024

(54) ADDITIVE COMPOSITION FOR MOTOR FUEL

(71) Applicant: TOTALENERGIES ONETECH, Courbevoie (FR)

(72) Inventor: Julien Sanson, Solaize (FR)

(73) Assignee: TotalEnergies OneTech, Courbevoie (FR)

( * ) Notice: Subject to any disclaimer, the term of this patent is extended or adjusted under 35 U.S.C. 154(b) by 0 days.

(21) Appl. No.: 17/928,171

(22) PCT Filed: May 28, 2021

(86) PCT No.: PCT/FR2021/050970
§ 371 (c)(1),
(2) Date: Nov. 28, 2022

(87) PCT Pub. No.: WO2021/240116
PCT Pub. Date: Dec. 2, 2021

(65) Prior Publication Data

US 2023/0203391 A1 Jun. 29, 2023

(30) Foreign Application Priority Data

May 29, 2020 (FR) ..... 2005698

(51) Int. Cl.
*C10L 10/04* (2006.01)
*C10L 1/222* (2006.01)
*C10L 10/06* (2006.01)

(52) U.S. Cl.
CPC ..... *C10L 1/2222* (2013.01); *C10L 10/04* (2013.01); *C10L 10/06* (2013.01); *C10L 2200/0259* (2013.01); *C10L 2200/0446* (2013.01); *C10L 2230/22* (2013.01); *C10L 2270/026* (2013.01)

(58) Field of Classification Search
CPC ..... C10L 1/22; C10L 1/222; C10L 1/2222; C10L 1/224; C10L 1/2383; C10L 1/2387; C10L 10/04; C10L 10/06; C10L 2200/0259; C10L 2200/0423; C10L 2200/0446; C10L 2230/22; C10L 2270/023; C10L 2270/026
See application file for complete search history.

(56) References Cited

U.S. PATENT DOCUMENTS

| | | | |
|---|---|---|---|
| 3,018,250 | A | 1/1962 | Anderson et al. |
| 3,048,479 | A | 8/1962 | Ilnyckyj et al. |
| 3,172,892 | A | 3/1965 | Le Suer et al. |
| 3,361,673 | A | 1/1968 | Stuart et al. |
| 3,627,838 | A | 12/1971 | Ilnyckyj et al. |
| 3,790,359 | A | 2/1974 | Feldman |
| 3,961,961 | A | 6/1976 | Rich |
| 4,171,959 | A | 10/1979 | Vartanian |
| 4,511,369 | A | 4/1985 | Denis et al. |
| 4,604,102 | A | 8/1986 | Zaweski et al. |
| 4,664,676 | A | 5/1987 | Denis et al. |
| 4,900,332 | A | 2/1990 | Denis et al. |
| 5,456,730 | A | 10/1995 | Hart et al. |
| 6,511,520 | B1 | 1/2003 | Eber et al. |
| 2015/0096516 | A1 | 4/2015 | Fang et al. |
| 2015/0315506 | A1 | 11/2015 | Dubois |
| 2016/0108331 | A1 | 4/2016 | Voelkel et al. |
| 2017/0058225 | A1* | 3/2017 | Papin ..... C10L 10/04 |
| 2020/0024536 | A1 | 1/2020 | Shanahan et al. |

FOREIGN PATENT DOCUMENTS

| | | | |
|---|---|---|---|
| EP | 261957 | A2 | 3/1988 |
| EP | 271385 | A1 | 6/1988 |
| EP | 565285 | A1 | 10/1993 |
| EP | 736590 | A2 | 10/1996 |
| EP | 680506 | B1 | 1/1997 |
| EP | 860494 | A1 | 8/1998 |
| EP | 861882 | A1 | 9/1998 |
| EP | 1254889 | A1 | 11/2002 |
| EP | 1344785 | A1 | 9/2003 |
| FR | 2528051 | A1 | 12/1983 |
| FR | 2528423 | A1 | 12/1983 |
| FR | 2772783 | A1 | 6/1999 |
| GB | 949981 | A | 2/1964 |
| WO | 9406894 | A1 | 3/1994 |
| WO | 9804656 | A1 | 2/1998 |
| WO | 2007015080 | A1 | 2/2007 |
| WO | 2006135881 | A3 | 3/2007 |
| WO | 2010132259 | A1 | 11/2010 |
| WO | 2015183908 | A1 | 12/2015 |

OTHER PUBLICATIONS

International Search Report for PCTFR2021050970 dated Jul. 30, 2021.
International Search Report for PCTFR2021050971 dated Sep. 20, 2020.

* cited by examiner

*Primary Examiner* — Ellen M McAvoy
*Assistant Examiner* — Chantel Graham
(74) *Attorney, Agent, or Firm* — Hahn Loeser & Parks LLP; John J. Cunniff

(57) ABSTRACT

The present invention relates to a fuel additive composition comprising at least a first additive chosen from quaternary ammonium salts different from betaines, and at least a second additive chosen from amido alkyl betaines, wherein the weight ratio of the amount of the first additive to the amount of the second additive is within the range of from 1:4 to 4:1. The invention also relates to an additive concentrate and to a fuel composition comprising this additive composition, and also to the use thereof for preventing and/or eliminating the deposits in at least one of the internal parts of an engine.

20 Claims, No Drawings

ADDITIVE COMPOSITION FOR MOTOR FUEL

The present invention relates to an additive composition for fuel comprising at least one first additive selected from quaternary ammonium salts different from betaines, and at least one second additive selected from amido alkyl betaines. The composition is such that the weight ratio of the amount of the first additive to the amount of the second additive is within the range of from 1:4 to 4:1.

The invention also relates to a fuel concentrate, comprising said additive composition, in a mixture with an organic liquid which is inert relative to the first and second additives and miscible with said fuel.

The invention further relates to a fuel composition comprising a fuel derived from one or more sources selected from the group consisting of the mineral, animal, plant and synthetic sources, and mixtures thereof; and said additive composition for fuel.

The invention also relates to the use of the additive composition, or of the fuel composition, or of the fuel concentrate, to maintain the cleanliness (keep-clean effect) and/or to clean (clean-up effect) the deposits in at least one of the internal parts of a gasoline or Diesel engine, preferably a Diesel engine, selected from the following ones: the combustion chamber and the fuel injection system.

In a preferred embodiment, the invention aims at preventing and/or reducing coke, and/or soaps and/or varnishes deposits on the injectors or on the needles of the injectors, as well as reducing the fuel consumption of an engine, preferably a Diesel engine, ("Fuel Eco" action) and/or minimising the power loss of said engine, and/or reducing the polluting emissions.

STATE OF THE PRIOR ART

Liquid fuels for internal combustion engines contain components which can be degraded during the operation of the engine. The problem of deposits in the internal parts of combustion engines is well known to motorists. It has been shown that the formation of these deposits has consequences on the engine performance and in particular has a negative impact on the consumption and the particulate emissions. The progress of the technology of the fuel additives have allowed dealing with this problem. Additives called detergents used in fuels have already been proposed to maintain the engine cleanliness by limiting the deposits ("keep-clean" effect) or by reducing the deposits which are already present in the internal parts of the combustion engine ("clean-up" effect). Document U.S. Pat. No. 4,171,959 which describes a detergent additive for gasoline fuel containing a quaternary ammonium function may be mentioned, by way of example. Document WO2006135881 describes a detergent additive containing a quaternary ammonium salt used to reduce or clean deposits in particular on the intake valves.

Nevertheless, the engine technology is constantly evolving and the fuel requirements must evolve to cope with these technological advances in combustion engines.

In particular, the new gasoline direct injection systems expose the injectors to more severe pressure and temperature conditions, which favours the formation of deposits.

In addition, these new injection systems have more complex geometries to optimise spraying, in particular, more numerous holes having smaller diameters but which, however, induces a greater sensitivity to deposits. The presence of deposits can alter the combustion performance, in particular increase the polluting emissions and the particulate emissions.

Furthermore, the new Diesel direct injection systems expose the injectors to more severe pressure and temperature conditions which favours the formation of deposits. Furthermore, these new injection systems have more complex geometries to optimise spraying, in particular, more numerous holes having smaller diameters, but which, however, induce a greater sensitivity to deposits.

In the case of indirect injection Diesel engines, the combustion of the fuel does not take place directly in the combustion chamber as for the direct injection engines. As described for example in document U.S. Pat. No. 4,604,102, there is a pre-chamber before the combustion chamber in which the injection of the fuel is performed. The pressure and the temperature in a pre-chamber are lower than those of a combustion chamber of direct injection engines. Under these conditions, the pyrolysis of the fuel produces coal which is deposited on the surface of the nozzles of the injectors ("throttling nozzle or "fouling"") and clogs the orifices of the nozzles: this phenomenon is coking. Only the surfaces of the nozzle which are exposed to the combustion gases have a risk of coal deposit (coking/coke). Coking is a phenomenon which only appears downstream of a Diesel injection system. In terms of performance, the phenomenon of coking induces an engine power loss and therefore in particular an overconsumption of fuel. This phenomenon is measured thanks to the XUD9 engine which allows determining the flow rates of the injectors and therefore the presence of coking or not.

The coking is to be distinguished from the "lacquering" (soap and/or varnish) which occurs in the Diesel direct injection engines, on the injector needles. Lacquering does not concern the deposits which are present outside the injection system and which are linked to the coking, at the origin of the fouling and the partial or total clogging of the injection nozzles. Lacquering and coking are therefore two phenomena which are very distinct both by the causes of these deposits, the conditions of appearance of these deposits and the place where these deposits occur.

The presence of these deposits, lacquering and coking, in the engines, can alter the performance of the combustion, and in particular increase the polluting emissions and the particulate emissions. Other consequences of the excessive presence of deposits have been reported in the literature, such as an increase in the fuel consumption.

The prevention and reduction of deposits in these (new) engines are essential for an optimal operation of today's motors. There is therefore a need to propose detergent additives for fuels promoting an optimal operation of the combustion engines, in particular but not limited to new engine technologies, but also the older/conventional engine technologies.

There is also a need for universal detergency solutions, which allows preventing or reducing all sorts of deposits on the internal parts of the internal combustion engine, regardless of the engine technology (Diesel or gasoline, direct or indirect injection) and/or the properties/nature of the fuel.

OBJECT OF THE INVENTION

The applicant discovered that a particular additive combination, as defined below, has remarkable and unexpected detergency properties for the gasoline or Diesel internal combustion engines and preferably in the compression ignition engines or Diesel engines. This additive combination allows guaranteeing and improving the detergency of fuels intended for the compression ignition engines. It also produces an unexpected synergistic effect, relative to each of the two additives considered alone.

The additional advantages of the additive composition for fuels according to the invention are:

- the protection of the pumps, of the injection systems and of all moving parts with which this additive comes into contact in an engine,
- an optimal operation of the engine,
- a reduction in the fuel consumption,
- saving due to less engine maintenance and a lower consumption,
- a reduction in particulate emissions.

Thus, the present invention relates to a fuel additive composition comprising:

(1) at least one first additive selected from quaternary ammonium salts different from betaines, and (2) at least one second additive selected from amido alkyl betaines of following formula (I):

(I)

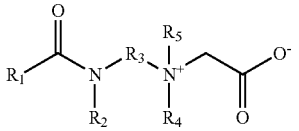

wherein

R1 is a linear or branched $C_1$ to $C_{34}$ hydrocarbon chain,

R2 is a hydrogen atom or a $C_1$ to $C_{15}$ hydrocarbon chain,

R3 is a $C_1$ to $C_{15}$ hydrocarbon chain, and

R4 and R5 are identical or different and selected independently of each other from a hydrogen atom and a $C_1$ to $C_{10}$, preferably $C_1$ to $C_6$, hydrocarbon chain, wherein the groups $R_4$ and $R_5$ can contain one or more nitrogen groups and/or can be bound together to form one or more rings; and wherein the weight ratio of the amount of the first additive to the amount of the second additive is within the range of from 1:4 to 4:1.

Preferably, the weight ratio of the amount of the first additive to the amount of the second additive is within the range of from 1:1 to 2.5:1, preferably from to 1.5:1 to 2.1:1.

The invention also relates to a fuel concentrate, comprising the additive composition, in a mixture with an organic liquid, said organic liquid being inert relative to the first and second additives, and miscible with said fuel.

The invention also relates to a fuel composition comprising:

(1) a fuel base derived from one or more sources selected from the group consisting of mineral, animal, plant and synthetic sources, and preferably selected from hydrocarbon fuels, non-essentially hydrocarbon fuels and the mixtures thereof; and (2) a fuel additive composition as defined in the present application.

Preferably, the liquid fuel composition is selected from hydrocarbon fuels, non-essentially hydrocarbon fuels, and mixtures thereof, for example gasolines or gas oils. Advantageously, the (hydrocarbon) fuel is selected from gas oils, also called diesel fuel, and which corresponds to the fuels employed in the Diesel engines.

According to a preferred embodiment, the additive composition, the fuel composition or the concentrate, according to the invention, is used to prevent (keep-clean effect) and/or eliminate (clean-up effect) the deposits in the internal parts of an engine which are selected from the following ones: the combustion chamber, the engine intake system and the fuel injection system, and preferably the fuel injection system. In particular, said composition is used in the liquid fuel to limit or avoid the formation of deposits in at least one of the internal parts of said engine and/or reduce deposits existing in at least one of the internal parts of said engine.

In particular, the composition according to the invention is used to prevent, reduce or eliminate the deposits selected from coke, and/or soaps and/or varnishes on the injectors or on the fuel injector needles, and/or coke, soap and/or valve-sticking of the fuel intake valves in the combustion chamber.

The composition according to the invention also allows reducing the fuel consumption of an engine, preferably a Diesel engine, ("Fuel Eco" action) and/or minimising the power loss of said engine, and/or reducing the pollutant emissions, in particular the particulate emissions from the combustion engine.

In one embodiment, the engine is a gasoline engine. In another more preferred mode, the internal combustion engine is a compression ignition engine, also known as a Diesel engine.

The present invention also relates to a method for maintaining the cleanliness and/or cleaning of at least one of the internal parts of an engine, preferably a compression ignition engine or Diesel engine, comprising at least the following steps:

- the preparation of a fuel composition by additivating a fuel with at least the two additives (1) and (2) as described below, or with a concentrate comprising them, then
- the combustion of said fuel composition in said engine.

Other objects, features, aspects and advantages of the invention will appear even more clearly on reading the following description and examples.

In what follows, and unless otherwise indicated, the limits of a range of values are included in this range, in particular in the expressions "comprised between" and "ranging from . . . to . . . ". Moreover, the expressions "at least one" and "at least" used in this description are respectively equivalent to the expressions "one or more" and "greater than or equal".

Finally, in a manner known per se, the term "$C_N$ or CN compound or group" designates a compound or a group containing N carbon atoms in the chemical structure thereof.

DETAILED DESCRIPTION

The First Additive: Quaternary Ammonium

The composition according to the invention comprises a first additive consisting of a quaternary ammonium salt, different from betaines.

In a first embodiment, the first additive is obtained by reaction with a quaternising agent of a nitrogen compound comprising a tertiary amine function, this nitrogen compound being the product of the reaction of an acylating agent substituted by a hydrocarbon group and of a compound comprising at least one tertiary amine group and at least one group selected from primary amines, secondary amines and alcohols.

In a second embodiment, the quaternary ammonium salt is selected from quaternised PIBA (polyisobutylene-amine) compounds, or from quaternised polyether-amines.

According to the first embodiment, which is preferred, said nitrogen compound is the product of the reaction of an acylating agent substituted by a hydrocarbon group and of a compound comprising both an oxygen atom and a nitrogen atom capable of being condensed with said acylating agent (that is to say at least one group selected from primary amines, secondary amines and alcohols) and a tertiary amine group.

The acylating agent is advantageously selected from mono- or poly-carboxylic acids and the derivatives thereof, in particular the ester, amide or anhydride derivatives thereof. The acylating agent is preferably selected from succinic, phthalic and propionic acids and the corresponding anhydrides.

In this embodiment, the acylating agent substituted by a hydrocarbon group. The term "hydrocarbon" group means any group having a carbon atom directly attached to the rest of the molecule (i.e. to the acylating agent) and having mainly an aliphatic hydrocarbon character.

Hydrocarbon groups according to the invention can also contain non-hydrocarbon groups. For example, they may contain up to one non-hydrocarbon group per ten carbon atoms provided that the non-hydrocarbon group does not significantly change the mainly hydrocarbon character of the group. Mention may be made, by way of example of such groups which are well known to the person skilled in the art, of hydroxyl groups, halogens (in particular chloro- and fluoro-groups), alcoxy, alkylmercapto, alkyl sulfoxy groups.

In one embodiment, preferably the hydrocarbon substituents do not contain such non-hydrocarbon groups and are purely aliphatic hydrocarbons.

The hydrocarbon substituent of the acylating agent preferably comprises at least 8, preferably at least 12 carbon atoms. Said hydrocarbon substituent may comprise up to about 200 carbon atoms.

The hydrocarbon substituents of the acylating agent preferably have a number average molecular weight (Mn) of between 160 and 2800, for example between 250 and 1500, more preferably between 500 to 1500 and, even more preferably between 500 and 1300. A range of $M_n$ values comprised between 700 and 1300 is particularly preferred, for example from 700 to 1200.

By way of example of hydrocarbon groups substituting the acylating agent, mention may be made of the n-octyl, n-decyl, n-dodecyl, tetrapropenyl, n-octadecyl, oleyl, octadecyl or triacontyl groups. The hydrocarbon substituent of the acylating agent can also be obtained from homo- or inter-polymers (for example of copolymers, terpolymers) of mono- and di-olefins having 2 to 10 carbon atoms, for example from ethylene, propylene, 1-butene, isobutene, butadiene, isoprene, 1-hexene or 1-octene. Preferably, these olefins are 1-mono-olefins.

The hydrocarbon substituent of the acylating agent can also be selected from the derivatives of halogenated (for example chlorinated or brominated) analogues of these homo- or inter-polymers.

According to a variant, the hydrocarbon substituent of the acylating agent can be obtained from other sources, for example from monomers of high molecular weight alkenes (for example, 1-tetracontene) and the chlorinated or hydrochlorinated analogues, aliphatic oil fractions, for example the paraffin waxes, the cracked, chlorinated and/or hydrochlorinated analogues thereof of white oils, synthetic alkenes, for example produced by the products by the Ziegler-Natta process (for example, the polyethylene greases) and other sources known to the person skilled in the art.

Any unsaturation in the hydrocarbon group of the acylating agent can optionally be reduced or eliminated by hydrogenation according to any known method.

The hydrocarbon substituent of the acylating agent is preferably essentially saturated, that is to say that it contains no more than one unsaturated carbon-carbon bond for each portion of ten carbon-carbon single bonds which are present.

The hydrocarbon substituent of the acylating agent contains, advantageously, no more than one non-aromatic carbon-carbon unsaturated bond for every 50 carbon-carbon bonds present.

According to a preferred embodiment, the hydrocarbon substituent of the acylating agent is a polyisobutene group also called polyisobutylene (PIB). Particularly preferred polyisobutenes (PIB) are called highly reactive polyisobutenes (PIB). The term "highly reactive polyisobutenes (PIB) means polyisobutenes (PIB) in which at least 50 mol %, preferably at least 70 mol % or more, of the terminal olefinic double bonds are of the vinylidene type as described in document EP0565285. In particular, the preferred PIBs are those having more than 80 mol % and up to 100 mol % of vinylidene terminal groups as described in the document EP1344785.

According to a particularly preferred embodiment, the acylating agent substituted by a hydrocarbon group is a polyisobutenyl succinic anhydride (PIBSA).

The preparation of polyisobutenyl succinic anhydrides is known per se, and widely described in the literature. The methods comprising the reaction between polyisobutenes (PIB) and maleic anhydride described in the documents U.S. Pat. Nos. 3,361,673 and 3,018,250 or the method comprising the reaction of a halogenated, in particular chlorinated, polyisobutene (PIB) with maleic anhydride (U.S. Pat. No. 3,172,892) may be mentioned by way of example.

Alternatively, the polyisobutenyl succinic anhydride may be prepared by mixing a polyolefin with maleic anhydride then by passing chlorine through the mixture (GB949981).

Other hydrocarbon groups comprising an internal olefin, for example such as those described in the application WO2007/015080, can also be used as a substituent for the acylating agent. The term "internal olefin" means any olefin containing mainly a non-alpha double bond, which is a beta or higher position olefin.

Preferably, these materials are essentially beta-olefins or higher position olefins, for example containing less than 10% by mass of alpha-olefin, advantageously less than 5% by mass or less than 2% by mass.

The internal olefins can be prepared by isomerisation of alpha-olefins according to any known method.

The compound comprising both an oxygen atom or a nitrogen atom capable of being condensed with the acylating agent and a tertiary amine group can, for example, be selected from the group consisting of dimethylaminopropylamine, N,N-diethylaminopropylamine, N,N-dimethylamino-ethylamine, N,N-dimethyl-amino ethylamine ethylenediamine, 1,2-propylenediamine, 1,3-propylenediamine, butylenediamines (isomers), diethylenetriamine, dipropylenetriamine, dibutylenetriamine, triethylenetetraamine, teraethylenenepentaamine, pentaethylenehexaamine, hexamethylenetetramine, bis(hexamethylene)triamine, diaminobenzenes, and pentanediamines, hexanediamines, heptanediamines, and preferably N,N-dimethylaminopropylamine.

Said compound can also be selected from heterocyclic compounds substituted by alkylamines such as 1-(3-aminopropyl)-imidazole, 4-(3-aminopropyl)morpholine, 1-(2-aminoethyl)piperidine, 3,3-diaminoo-N-methyldipropylamine, diaminopyridines, and 3',3-bisamino(N,N-dimethylpropylamine).

The compound comprising both an oxygen atom or a nitrogen atom capable of being condensed with the acylating agent and a tertiary amine group can also be selected from alcanolamines, including, but not limited to, triethanolamine, trimethanolamine, N,N-dimethylaminopropanol, N,N-dimethylaminoethanol, N,N-diethylaminopropanol, N,N-diethylaminoethanol, N,N-diethylaminobutanol, N,N,N-tris(hydroxyethyl)amine, N,N,N-tris(hydroxymethyl) amine, N,N,N tris(aminoethyl)amine, N,N-dibutylaminopropylamine and N,N,N'-trimethyl-N'-hydroxyethylbisaminoethylether, N,N-bis(3-dimethylamino-propyl)-N-isopropanolamine, N-(3-dimethylamino)propyl)-N,N-diisopropanolamine, N'-(3-(Dimethylamino)propyl)-N,N-dimethyl-1,3-propanediamine; 2-(2-dimethylaminoethoxy) ethanol and N,N,N'-trimethylaminoethylethanolamine, or mixtures thereof.

According to a preferred embodiment, said compound comprising at least one tertiary amine group and at least one group selected from primary amines, secondary amines and the alcohols is selected from the following amines of formula (I) or (II):

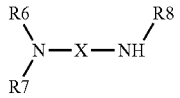

(II)

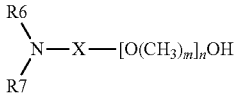

(III)

wherein

R6 and R7 are identical or different and represent, independently of each other, an alkyl group having 1 to 22 carbon atoms, preferably having 1 to 5 carbon atoms;

X is an alkylene group having 1 to 20 carbon atoms, preferably 1 to 5 carbon atoms;

m is an integer comprised between 1 and 5;

n is an integer comprised between 0 and 20; and

R8 is a hydrogen atom or a C1 to C22 alkyl group.

Said compound is preferably selected from amines of formula (I).

When the nitrogen compound comprises an amine of formula (I), R8 is advantageously a hydrogen atom or a C1 to C16 alkyl group, preferably a C1 to C10 alkyl group, even more preferably a C1 to C6 alkyl group.

R8 can, for example, be selected from the group consisting of hydrogen, methyl, ethyl, propyl, butyl and the isomers thereof. Preferably R8 is a hydrogen atom.

When the nitrogen compound comprises an amine of formula (II), m is preferably equal to 2 or 3, more preferably equal to 2; n is preferably an integer comprised between 0 to 15, more preferably between 0 to 10, even more preferably between 0 to 5. Advantageously, n is 0.

According to a preferred embodiment, said nitrogen compound is the product of the reaction of the acylating agent substituted by a hydrocarbon group and a diamine of formula (I).

In this embodiment:

R6 and R7 can represent, independently of each other, a C1 to C16 alkyl group, preferably a C1 to C10 alkyl group;

R6 and R7 may represent, independently of each other, a methyl, ethyl, propyl, butyl, pentyl, hexyl, heptyl, octyl group or the isomers thereof. Advantageously, R6 and R7 represent, independently of each other, a C1 to C4 group, preferably a methyl group;

X represents an alkylene group having 1 to 16 carbon atoms, preferably 1 to 12 carbon atoms, more preferably 1 to 8 carbon atoms, for example 2 to 6 carbon atoms or 2 to 5 carbon atoms. X represents, in a particularly preferred manner, an ethylene, propylene or butylene group, in particular a propylene group.

According to a particularly preferred embodiment, the nitrogen compound is the reaction product of a succinic acid derivative substituted by a hydrocarbon group, preferably a polyisobutenyl succinic anhydride, and an alcohol or an amine also including a tertiary amine group, in particular a compound of formula (I) or (II) as described above and most preferably a compound of formula (I).

According to a first variant, the succinic acid derivative substituted by a hydrocarbon group reacts with the amine also comprising a tertiary amine group under conditions to form a succinimide (closed form). The reaction of the succinic acid derivative and the amine can also lead, under certain conditions, to a succinamine, that is to say, a compound comprising an amide group and a carboxylic acid group (open form).

According to a second variant, an alcohol also comprising a tertiary amine group reacts with the succinic acid derivative to form an ester also comprising a free carboxyl-$CO_2H$ group (open form). Thus, in certain embodiments, the nitrogen compound can be the reaction product of a succinic acid derivative and an amine or an alcohol which is an ester or an amide and which further also comprises an unreacted carboxyl-$CO_2H$ group (open form).

The quaternary ammonium salt forming the first additive according to the present invention is directly obtained by reaction between the nitrogen compound described above comprising a tertiary amine function and a quaternising agent.

According to a particular embodiment, the quaternising agent is selected from the group consisting of dialkyl sulphates, carboxylic acid esters; alkyl halides, benzyl halides, hydrocarbon carbonates, and hydrocarbon epoxides optionally in a mixture with an acid, alone or as a mixture, preferably carboxylic acid esters.

For fuel applications, it is often desirable to reduce the content of halogen, sulphur and phosphorus-containing compounds.

Thus, if a quaternising agent containing such an element is used, it may be advantageous to perform a subsequent reaction to exchange the counterion. For example, a quaternary ammonium salt formed by reacting with an alkyl halide can then be reacted with sodium hydroxide and the sodium halide salt removed by filtration.

The quaternising agent can comprise halides such as chloride, iodide or bromide; hydroxides; sulphonates; bisulphites; alkyl sulphates such as dimethyl sulphate; sulphone; phosphates; C1-C12 alkylphosphates; C1-C12 dialkylphosphates; borates; C1-C12 alkylborates; nitrites; nitrates; carbonates; bicarbonates; alkanoates; C1-C12 O, O-dialkyldithiophossphates, alone or in a mixture.

According to a particular embodiment, the quaternising agent can be selected from derivatives of dialkylsulphate such as dimethylsulphate, N-oxides, sulphate such as propane- and butane-sulphone, alkyl, acyl or aralkyl such as methyl and ethyl chloride, benzyl bromide, iodide or chloride, and hydrocarbon carbonates (or alkyl carbonates).

If the acyl halide is benzyl chloride, the aromatic ring is optionally substituted by one or more alkyl or alkenyl groups.

The hydrocarbon (alkyl) groups of hydrocarbon carbonates can contain 1 to 50, 1 to 20, 1 to 10 or 1 to 5 carbon atoms per group. According to one embodiment, the hydrocarbon carbonates contain two hydrocarbon groups which can be identical or different. By way of example of hydrocarbon carbonates, dimethyl or diethyl carbonate may be mentioned.

According to a preferred embodiment, the quaternising agent is selected from the hydrocarbon epoxides represented by the following formula (III):

(III)

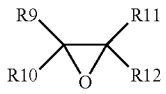

wherein R9, R10, R11 and R12 can be identical or different and represent independently of each other a hydrogen atom or a $C_1$ to $C_{50}$ hydrocarbon group. By way of non-limiting example, mention may be made of styrene oxide, ethylene oxide, propylene oxide, butylene oxide, stilbene oxide and $C_1$ to $C_{50}$ epoxides. Styrene oxide and propylene oxide are particularly preferred, and more preferably the quaternising agent is propylene oxide.

Such hydrocarbon epoxides can be used as a quaternising agent in combination with an acid, for example with acetic acid. Hydrocarbon epoxides can also be used alone as a quaternising agent, in particular without additional acid.

Without being bound by this hypothesis, it would seem that the presence of the carboxylic acid function in the molecule promotes the formation of the quaternary ammonium salt. In such an embodiment not using additional acid, a protic solvent is used for preparing the quaternary ammonium salt. By way of example, protic solvents such as water, alcohols (including polyhydric alcohols) can be used alone or in a mixture. The preferred protic solvents have a dielectric constant greater than 9.

Corresponding quaternary ammonium salts prepared from amides or esters and succinic acid derivatives are described in WO21010/132259 or in EP1896555.

According to another embodiment, the quaternising agent is selected from the compounds of formula (IV):

(IV)

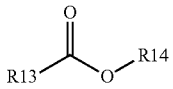

wherein R13 is an optionally substituted alkyl, alkenyl, aryl and aralkyl group, and R14 is a $C_1$ to $C_{22}$ alkyl, aryl or alkylaryl group.

The compound of formula (IV) is a carboxylic acid ester capable of reacting with a tertiary amine to form a quaternary ammonium salt. Compounds of formula (IV) are selected, for example from carboxylic acid esters having a pKa of 3.5 or less. The compound of formula (IV) is, preferably, selected from esters of substituted aromatic carboxylic acid, of alpha-hydroxycarboxylic acid and of polycarboxylic acid.

According to one embodiment, the ester is a substituted aromatic carboxylic acid ester of formula (IV) wherein R13 is a substituted aryl group. Preferably, R13 is a substituted aryl group having 6 to 10 carbon atoms, preferably a phenyl or naphtyl group, more preferably a phenyl group. R13 is advantageously substituted by one or more groups selected from carboalkoxy, nitro, cyano, hydroxy, $SR_{15}$ and $NR_{15}R_{16}$ radicals. Each of the groups $R_{15}$ and $R_{16}$ can be a hydrogen atom or an optionally substituted alkyl, alkenyl, aryl or carboalkoxy group. Each of the groups $R_{15}$ and $R_{16}$ advantageously represents a hydrogen atom or an optionally substituted C1 to C22 alkyl group, preferably a hydrogen atom or a C1 to C16 alkyl group, more preferably a hydrogen atom or a C1 to C10 alkyl group, even more preferably a hydrogen atom or a C1 to C4 alkyl group. $R_{15}$ is preferably a hydrogen atom and $R_{16}$ a hydrogen atom or a C1 to C4 group. Advantageously, $R_{15}$ and $R_{16}$ are both a hydrogen atom.

According to one embodiment, R13 is an aryl group substituted by one or more groups selected from hydroxyl, carboalkoxy, nitro, cyano and $NH_2$ radicals. R13 can be a polysubstituted aryl group, for example a trihydroxyphenyl group. Advantageously, R13 is a mono substituted, preferably ortho substituted, aryl group. R13 is, for example, substituted by a group selected from the OH, $NH_2$, $NO_2$ or COOMe, preferably OH or $NH_2$, radicals. R13 is preferably a hydroxy-aryl group, in particular 2-hydroxyphenyl.

According to a particular embodiment, R14 is an alkyl or alkylaryl group. R14 may be a C1 to C16 alkyl group, preferably a C1 to C10 alkyl group, advantageously a C1 to C8 alkyl group. R14 can be a C1 to C16 alkylaryl group, preferably a C1 to C10 alkylaryl group, advantageously C1 to C8 alkylaryl group. R14 can for example be selected from methyl, ethyl, propyl, butyl, pentyl, benzyl groups or the isomers thereof. Preferably, R14 is a benzyl or methyl group, more preferably a methyl group.

A particularly preferred compound is methyl salicylate.

According to a particular embodiment, the compound of formula (IV) is an ester of an alpha-hydroxycarboxylic acid corresponding to the following formula (V):

wherein R17 and R18 are identical or different and are independently (V)

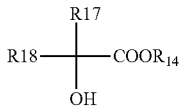

selected from the group consisting of a hydrogen atom, alkyl, alkenyl, aryl or aralkyl groups. Such compounds are for example described in document EP 1254889.

Examples of compounds of formula (IV) wherein R13COO is the residue of an alpha-hydroxycarboxylic acid comprise 2-hydroxy-isobutyric acid methyl-, ethyl-, propyl-, butyl-, pentyl-, hexyl-, phenyl-, benzyl- or allyl-esters; 2-hydroxy-2-methylbutyric acid methyl-, ethyl-, propyl-, butyl-, pentyl-, hexyl-, benzyl-, phenyl- or allyl-esters; 2-hydroxy-2-ethylbutyric acid methyl-, ethyl-, propyl-, butyl-, pentyl-, hexyl-, benzyl-, phenyl- or allyl-esters; lactic acid methyl-, ethyl-, propyl-, butyl-, pentyl-, hexyl-, benzyl-, phenyl- or allyl-esters and glycolic acid methyl-, ethyl-, propyl-, butyl-, pentyl-, hexyl-, allyl-, benzyl- or phenyl-esters. From the above, the preferred compound is methyl-2-hydroxyisobutyrate.

According to a particular embodiment, the compound of formula (IV) is a polycarboxylic acid ester selected from dicarboxylic acids and carboxylic acids having more than two acid functions. The carboxylic functions are preferably all in the esterified form. Preferred esters are C1-C4 alkyl esters.

The compound of formula (IV) can be selected from oxalic acid diesters, phthalic acid diesters, maleic acid diesters, malonic acid diesters or citric acid diesters. Preferably, the compound of formula (IV) is dimethyl oxalate.

According to a preferred variant, the compound of formula (IV) is a carboxylic acid ester having a pKa of less than 3.5. For cases where the compound comprises more than one acid group, reference will be made to the first dissociation constant.

The compound of formula (IV) can be selected from one or more carboxylic acid esters selected from oxalic acid, phthalic acid, salicylic acid, maleic acid, malonic acid, citric acid, nitrobenzoic acid, aminobenzoic acid and 2,4,6-trihydroxybenzoic acid. Preferred compounds of formula (IV) are dimethyl oxalate, methyl 2-nitrobenzoate and methyl salicylate.

According to a particularly preferred embodiment, the quaternary ammonium salt used in the invention is formed by reaction of a hydrocarbon epoxide, preferably selected from those of formula (III) above and more preferably propylene oxide, with the product of the reaction of a polyisobutenyl succinic anhydride whose polyisobutylene group (PIB) has a number average molecular weight (Mn) comprised between 700 and 1000 and dimethyl-aminopropylamine.

According to a particularly preferred embodiment, the additive (1) is selected from polyisobutylene succinimides functionalised with a quaternary ammonium group.

The composition according to the invention comprises the first additive(s) as described above at a preferential content ranging from 5 to 10,000 ppm by weight, preferably from 5 to 1,000 ppm by weight, more preferably from 10 to 500 ppm by weight, more preferably from 15 to 200 ppm by weight, and most preferably from 20 to 150 ppm by weight, relative to the total weight of the fuel composition.

The Second Additive: Betaine

The composition according to the invention comprises a second additive (2) selected from amido alkyl betaines of formula (I) below:

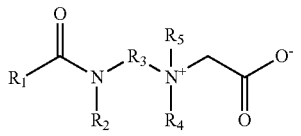

(I)

wherein

R1 is a linear or branched $C_1$ to $C_{34}$ hydrocarbon chain,

R2 is a hydrogen atom or a $C_1$ to $C_{15}$ hydrocarbon chain,

R3 is a $C_1$ to $C_{15}$ hydrocarbon chain, and

R4 and R5 are identical or different and selected independently of each other from a hydrogen atom and a $C_1$ to $C_{10}$ hydrocarbon chain, being understood that the groups R4 and R5 can contain one or more nitrogen groups and/or can be bound together to form one or more rings.

Preferably, in formula (I), R1 is a linear or branched $C_8$ to $C_{30}$, preferably $C_{12}$ to $C_{24}$, plus preferably $C_{16}$ to $C_{20}$, hydrocarbon chain.

Preferably, in formula (I), R2 is a hydrogen atom or a $C_1$ to $C_8$ hydrocarbon chain, preferably a hydrogen atom. Preferably, in formula (I), R3 is a $C_1$ to $C_8$, preferably $C_2$ to $C_4$, hydrocarbon chain.

Preferably, in formula (I), R4 and R5 are identical or different and selected independently of each other from a hydrogen atom and a $C_1$ to $C_6$ hydrocarbon chain, being understood that the groups $R_4$ and $R_5$ may contain one or more nitrogen groups and/or may be bound together to form a ring; more preferably R4 and R5 are identical and represent a methyl group or an ethyl group and even more preferably a methyl group.

In one embodiment, the second additive can be obtained by reacting:

(i) a tertiary amine of formula $R_4R_5R'_3N$:

wherein $R_4$, $R_5$ are as defined above for formula (I), the preferred meanings of these groups for the formula (I) being also preferred for said tertiary amine;

wherein $R'_3$ designates a group of formula —$R_3$—N($R_2$)—CO—$R_1$, wherein $R_1$, $R_2$ and $R_3$ are as defined above for formula (I), the preferred meanings of these groups for formula (I) being also preferred for said tertiary amine; with (ii) acetic acid substituted by at least one halogen, or one of the salts thereof, or one of the ester or amide derivatives thereof.

According to a preferred embodiment, the reaction product is substantially free of non-covalent anionic species.

Preferably, the compound (ii) is acetic acid substituted by a halogen, or a salt of such an acid.

Salts may include alkali or alkaline earth metals, or ammoniums, including but not limited to sodium, lithium, calcium, potassium, magnesium, triethyl ammonium or triethanol ammonium salts.

In a preferred embodiment, chloroacetic acid or sodium or potassium chloroacetate salts are used.

The molar ratio of the amount of carboxylic acid/ester/amide or one of the salts thereof (ii) to the amount of tertiary amine (i) is advantageously within the range of from 1:0.1 to 0.1:1.0.

In a particularly preferred embodiment, the additive (2) is the product of reaction:

(i) of a tertiary amine substituted by a hydrocarbon group selected from the ($C_8$-$C_{30}$ alkyl) amidopropyldi($C_1$-$C_4$ alkyl)amines and the ($C_8$-$C_{30}$ alkenyl) amidopropyldi($C_1$-$C_4$ alkyl)amines; preferably from the ($C_8$-$C_{30}$ alkyl) amidopropyldimethylamines and ($C_8$-$C_{30}$ alkenyl) amidopropyldimethylamines; with (ii) acetic acid substituted by a halogen, or one of the salts thereof, or one of the ester or amide derivatives thereof;

said reaction product preferably being devoid of non-covalent anionic species.

Preferably, compound (i) is oleylamidopropyl dimethylamine, and compound (ii) is sodium chloroacetate.

The Additive Composition

The composition according to the invention is such that the weight ratio of the amount of the first additive to the amount of the second additive is within the range of from 1:4 to 4:1.

Preferably, the weight ratio of the amount of the first additive to the amount of the second additive is within the range of from 1:1 to 2.5:1, preferably from 1.5:1 to 2.1:1.

According to an alternative embodiment, the weight ratio of the amount of the first additive on the amount of the second additive is within the range of from 1:3 to 3:1, preferably from 1:2 to 2:1.

According to another alternative embodiment, the weight ratio of the amount of the first additive to the amount of the second additive is within the range of from 1:3 to 1.5:1, preferably from 1:2.5 to 1:1.

Other Additives in the Additive Composition

The additive composition may also comprise one or more additional additive(s), different from said additives (1) and (2), which are described above.

This or these other additive(s) can be selected, for example, without limitation, from the detergent additives, the anti-corrosion agents, the dispersants, the demulsifiers, the anti-foaming agents, the biocides, the tracers or markers, the reodorants, the procetane additives, the friction modifiers, the lubricity additives or smoothness additives, the combustion assisting agents (catalytic combustion and soot promoters), the cold-resistant additives and in particular the agents improving the cloud point, the pour point, the CFPP ("Cold Filter Plugging Point"), the anti-sedimentation agents, the anti-wear agents and the conductivity modifying agents.

Among these additives, mention may be made in particular of:

a) procetane additives, in particular (but without limitation) selected from alkyl nitrates, preferably 2-ethyl hexyl nitrate, aryl peroxides, preferably benzyl peroxide, and alkyl peroxides, preferably ter-butyl peroxide;
b) anti-foaming additives, in particular (but without limitation) selected from polysiloxanes, oxyalkylated polysiloxanes, and fatty acid amides derived from vegetable or animal oils. Examples of such additives are given in EP861882, EP663000, EP736590;
c) cold flow improvers (CFI) selected from the ethylene and unsaturated ester copolymers, such as ethylene/vinyl acetate (EVA), ethylene/vinyl propionate (EVP), ethylene/vinyl ethanoate (EVE), ethylene/methyl methacrylate (EMMA), and ethylene/alkyl fumarate copolymers described, for example, in documents U.S. Pat. Nos. 3,048,479, 3,627,838, 3,790,359, 3,961,961 and EP261957;
d) cloud point additives, in particular (but without limitation) selected from the group consisting of by long-chain olefin/(meth)acrylic ester/maleimide terpolymer, and fumaric/maleic acid ester polymers. Examples of such additives are given in FR2528051, FR2528051, FR2528423, EP112195, EP172758, EP271385, EP291367;
e) cold operability polyfunctional additives selected from the group consisting of polymers based on olefin and alkenyl nitrate as described in EP573490;
f) lubricity additives or anti-wear agents, in particular (but without limitation) selected from the group consisting of fatty acids and the ester or amide derivatives thereof, in particular glycerol monooleate, and derivatives of mono- and polycyclic carboxylic acids. Examples of such additives are given in the following documents: EP680506, EP860494, WO98/04656, EP915944, FR2772783, FR2772784;
g) friction modifiers, in particular (but without limitation) selected from the group consisting of acids or fatty acids esters or mixtures of acids or fatty acids esters, for example oleic, linoleic, resinic, palmitic acids; or from fatty acid dimers, or mono or di-propoxylated esters; sorbitan esters; sucrose stearates; or from glycerol and the derivatives thereof; or pentaerythritol esters; or amines; and preferably selected from glycerol or polyglycerol esters, or acids or fatty acid esters, or mixtures thereof;
h) detergent additives different from the additives (1) and (2), in particular (but without limitation) selected from the group consisting of succinimides and polyetheramines.

The Fuel Concentrate

The present invention also relates to a fuel concentrate comprising an additive composition as defined above, in a mixture with an organic liquid, said organic liquid being inert relative to the first and second additives, and miscible with said fuel.

The organic liquid is advantageously inert relative to the constituents of the additive composition, and miscible with the liquid fuels, in particular those derived from one or more sources selected from the group consisting of the mineral sources, preferably oil, animal, vegetable and synthetic sources. The term "miscible" means the fact that the additives and the organic liquid form a solution or a dispersion so as to facilitate the mixing of the additives according to the invention in the liquid fuels according to the conventional fuel additivation methods.

The organic liquid is preferably selected from aromatic hydrocarbon solvents such as the solvent marketed under the name "SOLVESSO", alcohols, ethers and other oxygenated compounds, and paraffinic solvents such as hexane, pentane or isoparaffins, alone or as a mixture.

The concentrate may also comprise one or more additional additive(s), different from said additives according to the invention, as defined above.

The Fuel Composition

The present invention also relates to a fuel composition comprising:

(1) a fuel base derived from one or more sources selected from the group consisting of mineral, animal, plant and synthetic sources, and preferably selected from hydrocarbon fuels, non-essentially hydrocarbon fuels and the mixtures thereof; and
(2) the additive composition as defined above.

The fuel according to the present invention contains a base derived from one or more sources selected from the group consisting of mineral, animal, plant and synthetic sources, and is preferably selected from hydrocarbon fuels, non-essentially hydrocarbon fuels and the mixtures thereof.

Oil will preferably be selected as a mineral source.

The fuel is advantageously selected from hydrocarbon fuels and non-essentially hydrocarbon fuels, alone or as a mixture.

The term "hydrocarbon fuel" means a fuel consisting of one or more compounds consisting solely of carbon and hydrogen. Gasoline and gas oil are hydrocarbon fuels.

The term "non-essentially hydrocarbon fuel" means a fuel consisting of one or more compounds consisting not essentially of carbon and hydrogen, that is to say which also contain other atoms, in particular oxygen atoms.

According to a particular embodiment, the fuel composition may comprise at least one hydrocarbon fuel selected from the middle distillates of boiling temperature comprised between 100 and 500° C., preferably 150 to 450° C., preferably 150 to 400° C., preferably 150 to 370° ° C., or lighter distillates having a boiling temperature comprised between 50 and 260° C.

These distillates can for example be selected from the distillates obtained by direct distillation of crude hydrocarbons, the distillates under vacuum, the hydrotreated distillates, the distillates resulting from catalytic cracking and/or hydrocracking of vacuum distillates, the distillates resulting from ARDS (atmospheric residue desulfuration")-type conversion and/or visbreaking processes, the distillates resulting from the recovery of Fischer Tropsch cuts. Hydrocarbon fuels are typically gasolines and gas oils (also called Diesel fuel).

Advantageously, the fuel composition is selected from gas oils or gasolines, preferably from gas oils.

The gasolines include, in particular, all commercially available fuel compositions for spark ignition engine. By way of a representative example, gasolines meeting the NF EN 228 standard may be mentioned. Gasolines generally has sufficiently high octane numbers to avoid the knocking phenomenon. Typically, gasoline-type fuels marketed in Europe, compliant with the NF EN 228 standard have a motor octane number (MON) which is greater than 85 and a research octane number (RON) of at least 95. The gasoline-type fuels generally have a RON ranging from 90 to 100 and a MON ranging from 80 to 90, the RON and MON being measured according to the ASTM D 2699-86 or D 2700-86 standard.

Gas oils (fuels for Diesel engines) comprise, in particular, all commercially available fuel compositions for Diesel engines. The gas oils complying with the NF EN 590 standard may be mentioned, by way of a representative example.

Non-essentially hydrocarbon fuels include in particular oxygenates, for example distillates resulting from BTL (biomass to liquid) conversion) of plant and/or animal biomass, taken alone or in combination; biofuels, for example oils and/or esters of vegetable and/or animal oils; biodiesels of animal and/or plant origin and bioethanols.

The mixtures of hydrocarbon fuels and of non-essentially hydrocarbon fuels are typically $B_x$ type gas oils or Ex type gasolines.

The term "$B_x$ type gas oils for Diesel engine" means a diesel fuel which contains x % (v/v) of esters of vegetable or animal oils (including used cooking oils) transformed by a chemical method called transesterification, obtained by reacting this oil with an alcohol in order to obtain fatty acid esters (FAE). With methanol and ethanol, respectively, fatty acid methyl esters (FAME) and fatty acid ethyl ester (FAEE) are obtained. The letter "B" followed by a number indicates the percentage of FAE contained in the diesel fuel. Thus, a B99 contains 99% FAE and 1% middle distillates of fossil origin (mineral source), B20 contains 20% FAE and 80% middle distillates of fossil origin, etc. . . . . A distinction is therefore made between $B_0$ type gas oils which do not contain oxygenated compounds, $B_x$ type gas oils which contain x % (v/v) of vegetable oil or fatty acid esters, most often methyl esters (VOME or FAME), x designating a number ranging from 0 to 100. When FAE is used alone in the engines, the fuel is designated by the term B100.

The term "$E_x$ type gasoline for a spark ignition engine" means a gasoline fuel which contains x % (v/v) of oxygenates, generally ethanol, bioethanol, methyl-tertio-butyl-ether (MTBE) and/or ethyl-tertio-butyl-ether (ETBE), x designating a number ranging from 0 to 100.

Preferably, the sulphur content in the fuel composition is less than or equal to 1500 ppm by weight, preferably less than or equal to 1000 ppm by weight, preferably less than or equal to equal to 500 ppm by weight and preferably less than or equal to 50 ppm by weight, most preferably less than or equal to 10 ppm by weight, relative to the total weight of the composition, and advantageously without sulphur.

In one embodiment, additional additives may be present in said fuel composition, such as those defined above.

In one embodiment, the content of each of said first and second additives (1) and (2) ranges from 5 to 10,000 ppm by weight, preferably from 5 to 1000 ppm by weight, more preferably from 10 to 500 ppm by weight, more preferably from 12 to 400 ppm by weight, and most preferably from 15 to 350 ppm by weight based on the total weight of the fuel composition.

Use

Another object of the invention is the use of the additive composition, or of the fuel composition, or of the fuel concentrate, to maintain the cleanliness (keep-clean effect) and/or clean (clean-up effect) the deposits in at least one of the internal parts of an engine, preferably a Diesel engine, selected from the following: the engine air intake and air and fuel intake system, the combustion chamber and the fuel injection system, and preferably the fuel injection system.

Another object of the invention is the use of the additive composition, or of the fuel composition, or of the fuel concentrate fuel to prevent and/or reduce the coke, and/or soap and/or varnish deposits on the injectors or the needles of the injectors; and/or soap and/or valve-sticking of the gasoline engine valves, preferably to prevent and/or reduce soap and coking deposits and varnishes on the injectors or the needles of the injectors in the Diesel engines.

The deposits are distinguished depending on the type of internal combustion engine and the location of the deposits in the internal parts of said engine.

According to a preferred embodiment, the internal combustion engine is a compression ignition engine or Diesel engine, in particular a direct injection Diesel engine or an indirect injection Diesel engine, in particular a Diesel engine with Common-Rail injection system (CRDI "Common Rail Direct Injection"). The targeted deposits are located in at least one of the internal parts of said Diesel engine.

Advantageously, the targeted deposits are localized in the Diesel engine injection system, preferably located on an external part of an injector of said injection system, for example the nozzle of the injector and/or on an internal part of an injector of said injection system (IDID "Internal Diesel Injector Deposits"), for example on the surface of an injector needle.

The deposits can consist of deposits linked to the coking phenomenon and/or deposits of the soap and/or varnish type ("lacquering").

In one embodiment, the fuel composition according to the invention is used to reduce the fuel consumption of an engine, preferably Diesel engine ("Fuel Eco" action) and/or minimise the power loss of said gasoline or Diesel engine, and/or reduce the pollutant emissions, in particular the particulate emissions from the combustion engine.

Another object of the invention is the use of said additive composition to reduce fouling (that is to say to prevent and/or eliminate the deposits) in the area of the segments and/or pistons and/or liners of the engine.

In said uses, the engine is preferably a direct injection Diesel engine, the power loss can be determined according to the CEC F-98-08 standardised engine test method, but can also be an indirect injection Diesel engine.

Said compound(s) according to the invention can, advantageously, be used in the fuel to reduce and/or avoid the restriction of the fuel flow emitted by the injector of a Diesel engine.

In another embodiment, in said uses, the engine is preferably an indirect injection Diesel engine, said flow restriction being able to be determined according to the CEC F-23-01 standardised engine test method.

The fuel composition according to the invention can be used to supply the engines used in all types of applications, for example in light vehicles (LV), heavy goods vehicles (HGV), stationary machinery, Off-road machinery (mines, construction, public works . . . ), agricultural machinery, combustion vehicles or hybrid vehicles (rechargeable or not)

The additive composition or the concentrate according to the invention can be used in "severe" or "easier to treat" gas oils. The "severe" gas oils differ from the "easy to treat" gas oils in that they require a higher rate of treatment in the additive composition to be effective as an "easy to treat" gas oil.

Method (or Process) for Preparing the Fuel Composition

The fuel composition according to the invention can be prepared according to any known method, by additivating a liquid fuel base, as previously described, with at least the two additives as described above, and optionally one or more other additives different from the additives according to the invention, as previously described.

Method for Improving Engine Cleanliness

The invention also relates to a method for maintaining the cleanliness and/or cleaning of at least one of the internal parts, preferably of a Diesel engine, comprising at least the following steps:

- the preparation of a fuel composition by additivating a fuel with at least the two additives (1) and (2) as described above, or with a concentrate comprising them, then
- the combustion of said fuel composition in said engine.

All characteristics of the additives, fuel or of the use are applicable to the method.

According to a first embodiment, the engine is a direct or indirect injection spark ignition engine, or gasoline engine.

The internal part kept clean and/or cleaned of the spark ignition engine is, preferably, selected from the engine intake system, in particular the intake valves (IVD), the combustion chamber (CCD or TCD) and the fuel injection system, in particular the injectors of an indirect injection system (PFI) or the injectors of a direct injection system (DISI).

According to a second embodiment, the internal combustion engine is a compression ignition engine or Diesel engine, preferably a direct injection Diesel engine, in particular a Diesel engine with Common-Rail injection system (CRDI).

The internal part kept clean (keep-clean) and/or cleaned (clean-up) of the Diesel engine is, preferably, the injection system of the Diesel engine, preferably an external part of an injector of said injection system, for example the nozzle of the injector and/or one of the internal part of an injector of said injection system, for example the surface of an injector needle.

According to a preferred variant, the above step of preparing a fuel composition is preceded by a prior step of determining the content of hydrocarbon compound(s) to be incorporated in said fuel composition in order to reach a given specification relating to the detergency properties of the fuel composition.

This prior step falls within current practice in the field of fuel additivation and implies defining at least one characteristic representing the detergency properties of the fuel composition as well as a target value.

The representative characteristic of the detergency properties of the fuel will depend on the type of internal combustion engine, for example Diesel or spark ignition engine, the direct or indirect injection system and the location in the engine of the deposits targeted for cleaning and/or maintaining the cleanliness.

For the direct injection Diesel engines, the characteristic representative of the detergency properties of the fuel may, for example, correspond to the power loss due to the formation of the deposits in the injectors or the restriction of the fuel flow emitted by the injector during the operation of said engine.

The characteristic representing the detergency properties can also correspond to the appearance of deposits of the lacquering type at the needle of the injector (IDID).

Methods for evaluating the detergency properties of the fuels have been widely described in the literature and fall within the general knowledge of the person skilled in the art.

Mention may be made, by way of non-limiting example, of the tests which are standardised or recognized by the profession or the methods described in the following literature, for the Diesel engines:

- the DW 10 method, a CEC F-98-08 standardised engine test method, to measure the power loss in direct injection Diesel engines;
- the XUD 9 method, a CEC F-23-01 standardised engine test method, to measure the fuel flow restriction emitted by the injector;
- the method described by the applicant in the application WO2014/029770 page 17 to 20, for the evaluation of the lacquering deposits (IDID).

The examples below are given by way of illustration of the invention, and cannot be interpreted so as to limit its scope.

EXAMPLES

The examples below were produced from two gas oil type fuels:

- a gas oil called B7 containing 6.8% by volume of fatty acid methyl ester, representative of fuels for diesel engines used in Europe, and whose characteristics are detailed in Table 1 below;
- a gas oil called B0 containing no oxygenated compounds, representative of fuels for diesel engines used outside Europe, and whose characteristics are detailed in Table 2 below.

TABLE 1 characteristics of gas oil B7

| Characteristic | Method | Value |
|---|---|---|
| Measured net calorific value | ASTM D240 | 42.685 MJ/kg |
| Carbon content | ASTM D5291 | 83.8% by weight |
| Hydrogen content | ASTM D5291 | 13.2% by weight |
| Total oxygen content | Adapted ASTM D5291 | 0.5% by weight |
| Oxidation stability | ISO 12205 | 1 $g/m^3$ |
| Density at 15° C. | ISO 12185 | 835.7 $kg/m^3$ |
| Viscosity at 40° C. | ISO 3104 | 2.25 $mm^2/s$ |
| Cloud point (PTR)° | ISO 3015 | −6° C. |

TABLE 1-continued characteristics of gas oil B7

| Characteristic | Method | Value |
|---|---|---|
| Cold Filter Plugging Point (CFPP) | EN 116 | −24° C. |
| Distillation profile | ISO 3405 | |
| | Initial point | 158.6° C. |
| | Point at 5% vol. | 174.9° C. |
| | Point at 10% vol. | 181.2° C. |
| | Point at 20% vol. | 194.9° C. |
| | Point at 30% vol. | 212.7° C. |
| | Point at 40% vol. | 232.4° C. |
| | Point at 50% vol. | 252.9° C. |
| | Point at 60% vol. | 274.6° C. |
| | Point at 70% vol. | 296.1° C. |
| | Point at 80% vol. | 317.8° C. |
| | Point at 90% vol. | 338.4° C. |
| | Point at 95% vol. | 352.4° C. |
| | Final point | 365.9° C. |
| | E250 (% distilled at 250° C.) | 48.5% by volume |
| | E350 (% distilled at 350° C.) | 94.4% by volume |
| Flash point | ISO 2719 | 58.0° C. |
| Sulphur content | ASTM D5453 | 8.8 mg/kg |
| Water content | ISO 12937 | 70 mg /kg |
| Measured cetane number | ISO 5165 | 54.1 |
| Content of aromatic compounds | EN 12916 | 20% by weight |

TABLE 2 characteristics of gas oil B0

| Characteristic | Method | Value |
|---|---|---|
| Measured net calorific value | ASTM D240 | 42.670 MJ/kg |
| Carbon content | ASTM D5291 | 86.5% by weight |
| Hydrogen content | ASTM D5291 | 13.4% by weight |
| Total oxygen content | Adapted ASTM D5291 | <0.5% by weight |
| Oxidation stability | ISO 12205 | <1 g/m$^3$ |
| Density at 15° C. | ISO 12185 | 856.9 kg/m$^3$ |
| Viscosity at 40° C. | ISO 3104 | 3.46 mm$^2$/s |
| Cloud point (PTR)° | ISO 3015 | 9° C. |
| Cold Filter Plugging Point (CFPP) | EN 116 | 4° C. |
| Distillation profile | ISO 3405 | |
| | Initial point | 169.9° C. |
| | Point at 5% vol. | 190.2° C. |
| | Point at 10% vol. | 206.2° C. |
| | Point at 20% vol. | 225.9° C. |
| | Point at 30% vol. | 242.6° C. |
| | Point at 40% vol. | 257.5° C. |
| | Point at 50% vol. | 273.0° C. |
| | Point at 60% vol. | 289.1° C. |
| | Point at 70% vol. | 307.6° C. |
| | Point at 80% vol. | 330.7° C. |
| | Point at 90% vol. | 363.3° C. |
| | Point at 95% vol. | 389.7° C. |
| | Final point | 403.7° C. |
| | E250 (% distilled at 250° C.) | 35.0% by volume |
| | E350 (% distilled at 350° C.) | 86.4.4% by volume |
| Flash point | ISO 2719 | 57.5° C. |
| Sulphur content | ASTM D5453 | 1566 mg/kg |
| Water content | ISO 12937 | 100 mg /kg |
| Measured cetane number | ISO 5165 | 46.6 |
| Content of aromatic compounds | EN 12916 | 25.9% by weight |

Fuel compositions have been prepared by adding the following additives A1 and A2 to each of the gas oils B0 and B7:

A1: quaternary ammonium salt, formed by the reaction of propylene oxide with the condensation product of a polyisobutenyl succinic anhydride whose polyisobutylene (PIB) group has a number average molecular weight (Mn) of 1000 g/mol and dimethyl-aminopropylamine;

A2: amido alkyl betaine, obtained by reaction of oleylamidopropyl dimethylamine, with sodium chloroacetate.

The amount of additive added to each composition is detailed in Tables 3 and 4 below, in which the content of each additive is indicated in ppm by weight relative to the total weight of the final composition:

TABLE 3

| fuel compositions from gas oil B7 | | | |
|---|---|---|---|
| Added additives | Composition B7-1 | Composition B7-2 | Composition B7-3 |
| A1 | 250 | 0 | 125 |
| A2 | 0 | 250 | 125 |

TABLE 4

| fuel compositions from gas oil B0 | | | |
|---|---|---|---|
| Added additives | Composition B0-1 | Composition B0-2 | Composition B0-3 |
| A1 | 250 | 0 | 125 |
| A2 | 0 | 250 | 125 |

The performance in terms of detergency of each of the fuel compositions above were evaluated using the XUD9 engine test, consisting in determining the flow rate loss defined as corresponding to the restriction of the flow of a gas oil emitted by the injector of a Diesel engine with a pre-chamber during its operation, according to the CEC F-23-01 standardised engine test method. The purpose of this test is to evaluate the ability of the tested additive composition to reduce the deposits on the injectors of a Peugeot XUD9 A/L four-cylinder and Diesel pre-chamber injection engine.

The tests were performed with a Peugeot XUD9 A/L four-cylinder and Diesel pre-chamber injection engine equipped with clean injectors whose flow rate has been determined beforehand.

The motor follows the test cycle detailed in the following Table 5 repeated 134 times for a total duration of 10 hours and 3 minutes:

TABLE 5

| Step | Duration (s) | Speed (rpm) | Torque (Nm) |
|---|---|---|---|
| 1 | 30 | 1200 ± 30 | 10 ± 2 |
| 2 | 60 | 3000 ± 30 | 50 ± 2 |
| 3 | 60 | 1300 ± 30 | 35 ± 2 |
| 4 | 120 | 1850 ± 30 | 50 ± 2 |

The test conditions are as follows:

Coolant flow rate (step 2 only): 85±5 1/min

Temperatures:

Coolant outlet: 95±2° C.

Oil: 100±5° C.

Air inlet: 32±2° C.

Fuel (at the pump): 31±2° C.

Pressures:

At the inlet of the fuel pump: −50 to ±100 mbar

At the outlet of the fuel pump: −100 to ±100 mbar

Exhaust discharge pressure (step 2 only): 50±10 mbar air inlet: 950±10 mbar.

The following two consecutive phases were performed, with the same test method for each phase:

Phase 1 of fouling (or "dirty up") with the non-additivated reference gas oil (B7 or B0). The flow rate loss evaluated after this first phase is 80% on average.

Phase 2 of cleaning (or "clean up") with the candidate fuel.

At the end of the test, the flow rate of the injectors is evaluated again. The flow rate loss is measured on the four injectors. The results are expressed as a flow rate loss percentage for different needle lifts. Usually, the fouling values are compared with 0.1 mm of needle lift because they are more discriminating and more accurate and repeatable (repeatability <5%). The evolution of the flow rate loss before/after the test allows deducing the flow rate loss as a percentage. Taking into account the repeatability of the test, a significant detergent effect is affirmable for a reduction in flow rate loss, i.e. a flow rate gain which is greater than 10 points (>10%).

At the end of the test, as a result of the cleaning phase, the flow rate loss of the injectors is evaluated again, and the injector unclogging percentage is deduced therefrom.

The obtained results are detailed in Tables 6 and 7 below.

TABLE 6

| results with the additivated B7 type fuels | | | |
|---|---|---|---|
| Composition | B7-1 | B7-2 | B7-3 |
| Unclogging | 64% | 55% | 79% |

TABLE 7

| results with the additivated B0 type fuels | | | |
|---|---|---|---|
| Composition | B0-1 | B0-2 | B0-3 |
| Unclogging | 43% | 44% | 59% |

The above results show that the compositions according to the invention (B7-3 and B0-3) containing the combination of the additives A1 and A2 leads to very good results in terms of cleaning of the fouled injectors ("clean-up" effect). At identical total additive content (250 ppm), these results are significantly higher than those obtained with the comparative compositions containing only one of the two additives (compositions B7-1, B7-2, B0-1 and B0-2).

These results illustrate the synergistic effects provided by the combination of the two additives according to the present invention.

The invention claimed is:

1. A fuel additive composition comprising:

(1) at least one first additive selected from quaternary ammonium salts different from betaines, and (2) at least one second additive selected from amido alkyl betaines, of following formula (I):

(I)

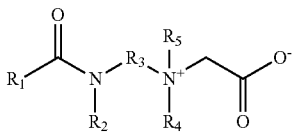

wherein

R1 is a linear or branched $C_1$ to $C_{34}$ hydrocarbon chain,

R2 is a hydrogen atom or a $C_1$ to $C_{15}$ hydrocarbon chain,

R3 is a $C_1$ to $C_{15}$ hydrocarbon chain, and

R4 and R5 are identical or different and selected independently of each other from a hydrogen atom and a $C_1$ to $C_{10}$ hydrocarbon chain, wherein the groups R4 and R5 can contain one or more nitrogen groups and/or can be bound together to form one or more rings; and wherein the weight ratio of the amount of the first additive to the amount of the second additive is within the range of from 1:4 to 4:1.

2. The composition according to claim 1, characterised in that in formula (I), R1 is a linear or branched $C_8$ to $C_{30}$ hydrocarbon chain.

3. The composition according to claim 1, characterised in that in formula (I), R2 is a hydrogen atom or a $C_1$ to $C_8$ hydrocarbon chain.

4. The composition according to claim 1, characterised in that in formula (I), $R_3$ is a $C_1$ to $C_8$ hydrocarbon chain.

5. The composition according to claim 1, characterised in that in formula (I), R4 and R5 are identical or different and selected independently of each other from a hydrogen atom and a $C_1$ to $C_6$ hydrocarbon chain, wherein the groups $R_4$ and $R_5$ can contain one or more nitrogen groups and/or can be bound together to form a ring.

6. The composition according to claim 1, characterised in that the weight ratio of the amount of the first additive to the amount of the second additive is within the range of from 1:1 to 2.5:1.

7. The composition according to claim 1, characterised in that said first additive (1) is obtained by reaction with a quaternising agent of a nitrogen compound comprising a tertiary amine function, this compound being the product of the reaction of an acylating agent substituted by a hydrocarbon group and of a compound comprising at least one tertiary amine group and at least one group selected from primary amines, secondary amines and alcohols.

8. The composition according to claim 7, wherein the acylating agent substituted by a hydrocarbon group is selected from mono- or poly-carboxylic acids and the derivatives thereof, including the ester, amide or anhydride derivatives thereof.

9. The composition according to claim 7, wherein the acylating agent substituted by a hydrocarbon group is a polyisobutenyl succinic anhydride.

10. The composition according to claim 7, wherein the compound comprising at least one tertiary amine group and at least one group selected from primary amines, secondary amines and alcohols is selected from amines of the following formulas (II) or (III):

wherein:

(II)

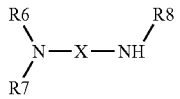

(III)

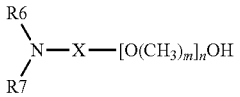

R6 and R7 are identical or different and represent, independently of each other, an alkyl group having 1 to 22 carbon atoms;

X is an alkylene group having 1 to 20 carbon atoms;

m is an integer comprised between 1 and 5;

n is an integer comprised between 0 and 20; and

R8 is a hydrogen atom or a C1 to C22 alkyl group.

11. The composition according to claim 7, wherein the quaternising agent is selected from the group consisting of dialkyl sulphates, carboxylic acid esters; alkyl halides, benzyl halides, hydrocarbon carbonates, and hydrocarbon epoxides optionally mixed with an acid, alone or as a mixture.

12. The composition according to claim 1, characterised in that the additive (2) is the product of reaction:

(i) of a tertiary amine substituted by a hydrocarbon group selected from the ($C_8$-$C_{30}$ alkyl) amidopropyldi($C_1$-$C_4$ alkyl)amines and the ($C_8$-$C_{30}$ alkenyl) amidopropyldi ($C_1$-$C_4$ alkyl)amines; with (ii) acetic acid substituted by a halogen, or one of the salts thereof, or one of the ester or amide derivatives thereof.

13. The composition according to claim 12, wherein compound (i) is oleylamidopropyl dimethylamine, and compound (ii) is sodium chloroacetate.

14. A fuel concentrate, comprising an additive composition according to claim 1, in a mixture with an organic liquid, said organic liquid being inert relative to the first and second additives, and miscible with said fuel.

15. A fuel composition comprising:

(1) a fuel base derived from one or more sources selected from the group consisting of mineral, animal, plant and synthetic sources; and (2) an additive composition as defined in claim 1.

16. The fuel composition according to claim 15, wherein the fuel is selected from diesel fuels.

17. The fuel composition according to claim 15, wherein the content of each of the additives (1) and (2) is within the range of from 5 to 10000 ppm by weight.

18. Use of the additive composition as defined in claim 1, to prevent (keep-clean effect) and/or to eliminate (clean-up effect) the deposits in at least one of the internal parts of an engine, selected from the following ones: the combustion chamber, the engine intake system and the fuel injection system.

19. The use of the fuel composition as defined in claim 15, to reduce the fuel consumption of a Diesel engine ("Fuel Eco" action) and/or lower the power loss of said engine, and/or reduce the pollutant emissions, in particular the particulate emissions from the combustion engine.

20. A method for maintaining the cleanliness and/or cleaning of at least one of the internal parts of an engine, comprising at least the following steps:

the preparation of a fuel composition by additivating a fuel with at least the two additives (1) and (2) as defined in claim 1, then the combustion of said fuel composition in said engine.

* * * * *